US007857379B2

(12) United States Patent
Leng

(10) Patent No.: US 7,857,379 B2
(45) Date of Patent: Dec. 28, 2010

(54) FOLDING STRUCTURE FOR A FOLDING CHAIR

(75) Inventor: Luhao Leng, Fujian (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 544 days.

(21) Appl. No.: 11/794,629

(22) PCT Filed: Jul. 27, 2004

(86) PCT No.: PCT/CN2004/000868

§ 371 (c)(1),
(2), (4) Date: Jun. 29, 2007

(87) PCT Pub. No.: WO2005/048780

PCT Pub. Date: Jun. 2, 2005

(65) Prior Publication Data

US 2009/0273212 A1 Nov. 5, 2009

(30) Foreign Application Priority Data

Nov. 21, 2003 (CN) ..... 2003 1 0105695
Feb. 24, 2004 (CN) ..... 2004 2 0038657. U

(51) Int. Cl.
*A47C 4/00* (2006.01)

(52) U.S. Cl. ..... 297/57; 297/55; 297/56; 297/33

(58) Field of Classification Search ..... 297/33, 297/55, 56, 57
See application file for complete search history.

(56) References Cited

U.S. PATENT DOCUMENTS

| | | | | | |
|---|---|---|---|---|---|
| 404,589 | A | | 6/1889 | Batt | |
| 828,501 | A | * | 8/1906 | Peabody | 248/164 |
| 1,608,911 | A | * | 11/1926 | Smith | 248/432 |
| 1,800,107 | A | * | 4/1931 | Schmitt | 297/57 |
| 2,532,873 | A | * | 12/1950 | Abramson et al. | 297/56 |
| 2,552,883 | A | * | 5/1951 | Cable | 297/57 |
| 2,572,739 | A | * | 10/1951 | Madsen | 297/57 |
| 2,729,275 | A | | 1/1956 | Morgan et al. | |
| 4,890,881 | A | * | 1/1990 | Ollat et al. | 297/26 |
| 5,464,268 | A | * | 11/1995 | Levrangi | 297/57 |
| 6,279,991 | B1 | | 8/2001 | Atkins et al. | |

* cited by examiner

*Primary Examiner*—Sarah B McPartlin
(74) *Attorney, Agent, or Firm*—Rabin & Berdo, P.C.

(57) ABSTRACT

A folding chair, including a first folding support and a second folding support, the first folding support includes a first front leg, a first back leg and a seat, the upper-end of the first front leg is pivotally connected to the lateral front-end of the seat, the first front leg is pivotally cross-linked with the first back leg, the lateral side of the seat is slidably and pivotally connected to the first back leg; the second folding support includes a second front leg, a second back leg and a second horizontal bearing-rod, connection of the second folding support is similar to that of the first folding support.

3 Claims, 11 Drawing Sheets

A-A

B

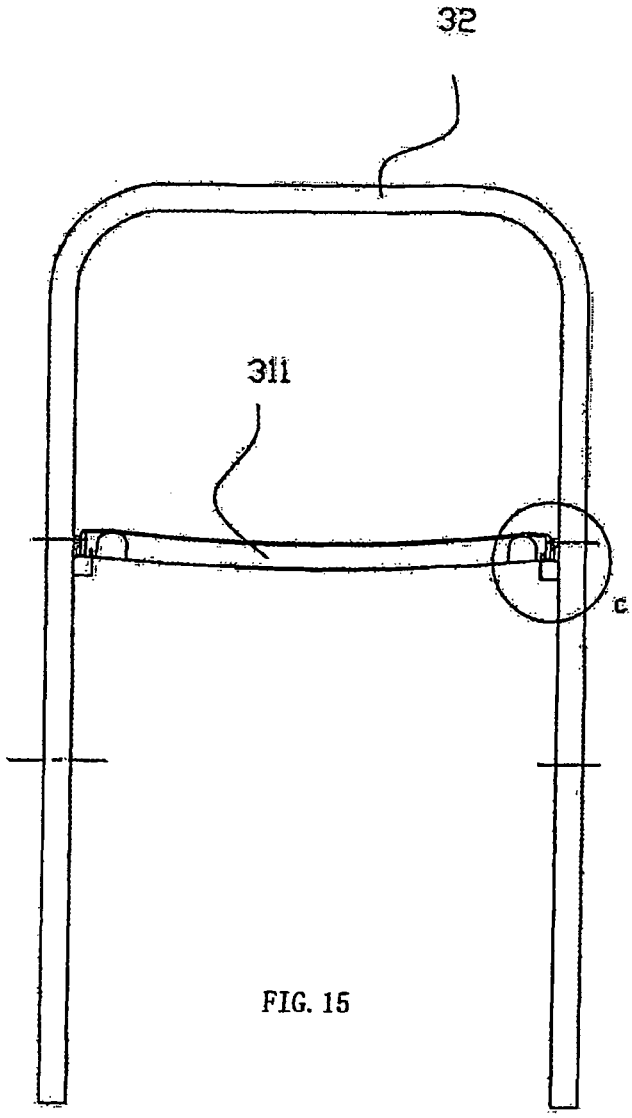
FIG. 15
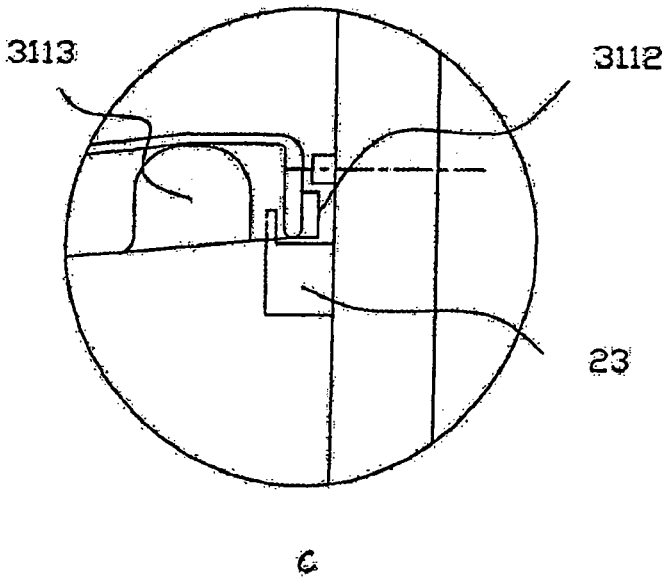

FOLDING STRUCTURE FOR A FOLDING CHAIR

FIELD

This invention relates to a kind of folding chair which is used in homes and offices, more particularly the invention relates a kind of folding structure of the folding chair which is more compact, and has a greater connection strength, thereby occupying less space after it is folded.

BACKGROUND

In modern furniture, whether the furniture is used in homes or in offices, in order to enhance their practicability, comfortableness and convenience of using, the functional requirements of the furniture are higher and higher, and they are required to be manufactured compactly, to occupy less space after they are folded. Most existing folding chairs constructed as shown in FIG. 18, consisting of a first folding support 1', a second folding support 2', a first connected piece 3', a second connected piece 4', a seat 5', a seat support 6', a backrest 7', a front rail 8', and a back rail 9'.

The first folding support 1' includes a first front leg 11', a first back leg 12'; the second folding support 2' includes a second front leg 21', a second back leg 22'. Two four-bar linked setups are respectively formed by the first front leg 11', the first back leg 12', the first connected piece 3', the seat support 6' and the second front leg 21', the second back leg 22', the second connected piece 4', the seat support 6'. When it is in the use position, the folding chair is unfolded, a first convex pole 10' and a second convex pole 20' on the two ends of the seat support 6' are respectively leaned against the first connected piece 3' and the second connected piece 4', so that the seat 5' can be fixed flatly.

The first back leg 12' and the second back leg 22' are inserted in the two lateral sides of the backrest 7', the two lateral sides of the backrest 7' and the two legs are fixed by screw. The two ends of the seat support 6' are inserted in the two lateral sides of the seat 5'.

As mentioned above, after the folding chair is folded, the back-lower parts of the first front leg 11' and the second front leg 21' are respectively leaned against the first back leg 12' and the second back leg 22', the front-end of the backrest 7' is leaned against the upper-end of the seat 5', therefore, the thickness of the folded chair includes the summation of the diameter of the two legs, it still occupies more space after it is folded. In other words, the existing folding chairs are superposed by the front and back leg, although the size is much smaller, but there is still much space for lowering.

SUMMARY

This invention offers a kind of folding structure of folding chair, the main purpose is to overcome the drawbacks that the thickness of the folding chair and still occupying more space.

The technology according to this invention is: A folding chair, comprising a first folding support and a second folding support, the first folding support includes a first front leg, a first back leg and a seat, the upper-end of the first front leg is pivotally connected to the lateral front-end of the seat, the first front leg is pivotally cross-linked with the first back leg, the lateral side of the seat is slidably and pivotally connected to the first back leg; the second folding support includes a second front leg, a second back leg and a second horizontal bearing-rod, its connection is similar to that of the first folding support.

The seat is slidably and pivotally connected to the first and second back legs by a sliding piece, the sliding piece is pivotally connected to the back leg, the sliding piece is slidably connected to the seat.

The sliding piece is a sliding thimble, where a first sliding thimble is pivotally fixed on the inner lateral approximately middle part of the first back leg, one of the lateral sides of the seat is slidably shuttled in the first sliding thimble; a second sliding thimble is pivotally fixed on the inner lateral approximately middle part of the second back leg, the other side of the seat is slidably shuttled in the second sliding thimble.

The lateral sides of the seat are slidably and pivotally connected to the first and second back legs, the concrete connection is that, a first sliding groove is fixed on the lateral side of the seat, a first convex pole is fixed on the corresponding position of the inner lateral side of the first back leg, the first convex pole is slidably shuttled in the first sliding groove; a second sliding groove is fixed on the other lateral side of the seat, a second convex pole is fixed on the corresponding position of the inner lateral side of the second back leg, the second convex pole is slidably shuttled in the second sliding groove.

A bulge which can prevent sliding is on the end of the lateral side of the seat.

The first and second front legs are connected to the first and second back legs by a U shape connection piece; or when it is the tubal connection, a corresponding concessive gap is fixed on the lateral side of the seat.

Two concessive gaps are on the back-ends of the seat, the front leg is deposited in the concessive gap after the chair is folded.

The distance between the joint of the first front leg, the first back leg and the joint of the first front leg, the seat, is longer than the distance between the joint of the first front leg, the first back leg and the joint of the first back leg, the seat.

The first back leg presents a backswept bending arc line, the shape of the first front leg and the shape of the seat are corresponding with the shape of the first back leg, when the joint of the seat and the first back leg is sliding to the front-end of the seat, the seat, the first front leg, the first back leg are located on a same arc surface.

As known from the description to the structure of this invention, after the folding structure of this invention is folded, firstly, the first, second front legs of the first, second folding support and the seat are all deposited in a plane which is formed by the first back leg and the second back leg, the former folding chair is just that the front legs and the back legs are mutually superposed, but this invention is that the front legs are sandwiched in the back legs, therefore, the thickness is small after it is folded, and occupying less space, secondly, the front legs and the back legs of the chair are connected together, the front legs are connected to the seat, so the strength of the structure is high; thirdly, the chair can be folded only by lifting the front of the seat, being forced from the top of the chair has the same effect with fastening the chair, the drawbacks of the existing chair that it is easily folded, it is not steady, it cannot be stood-up have been changed; fourthly, the seat is slidably and pivotally connected to the back legs, when the chair is folded, the seat is deposited under the joints of the back legs and the seat, so there is much space for the backrest, especially it can be fixed on the position which is suitable for a person to sit down, the drawbacks of the existing chair that the backrest is in a high position, not suitable for sitting have been changed.

BRIEF DESCRIPTION OF THE DRAWINGS

FIG. 15 is a perspective view of the sliding structure of the embodiment 3, C is the partial amplificatory view.

DETAILED DESCRIPTION OF THE PREFERRED EMBODIMENTS

Figure 1:
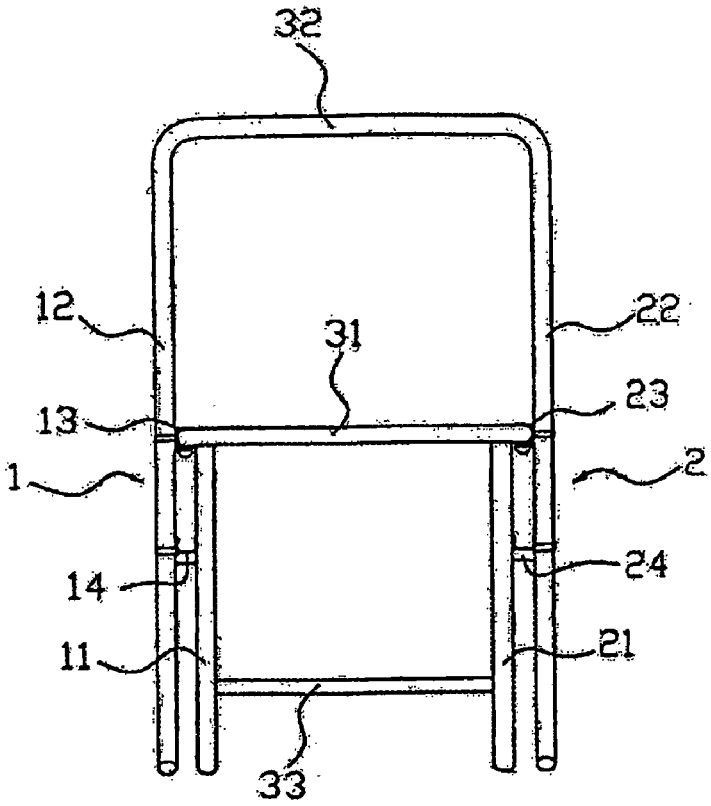
FIG. 1 is an elevational view of the embodiment 1.
Figure 2:
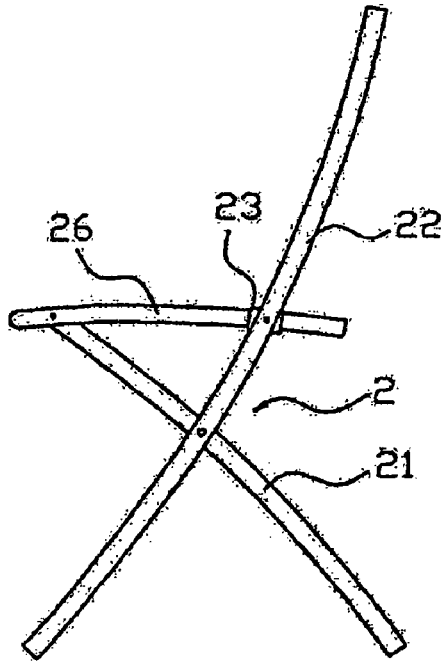
FIG. 2 is a right side view of the embodiment 1.
Figure 3:
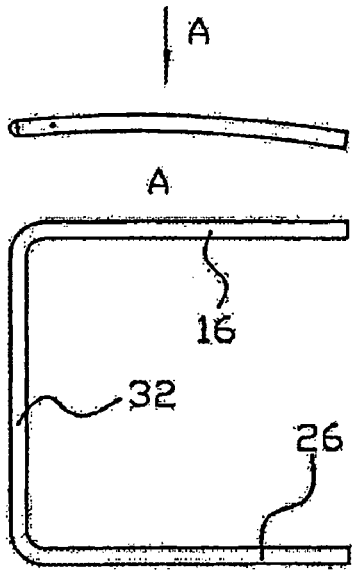
FIG. 3 is a perspective view of the U shape pole which is composed of the first horizontal bearing-rod, the second horizontal bearing-rod and the first rail of the embodiment 1.
Figure 4:
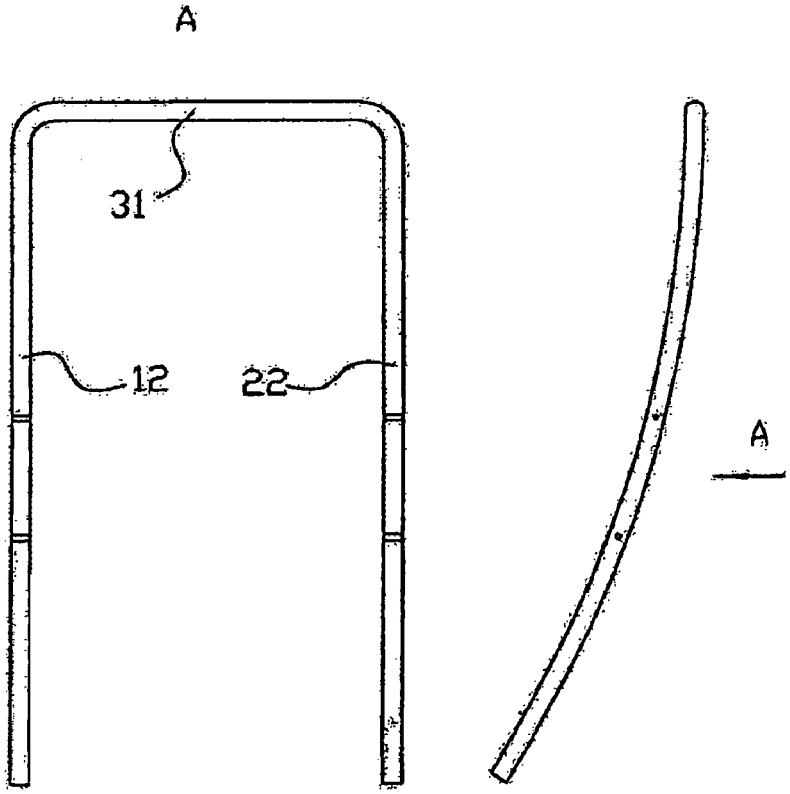
FIG. 4 is a perspective view of the U shape pole which is composed of the first back leg, the second back leg and the first rail of the embodiment 1.
Figure 5:
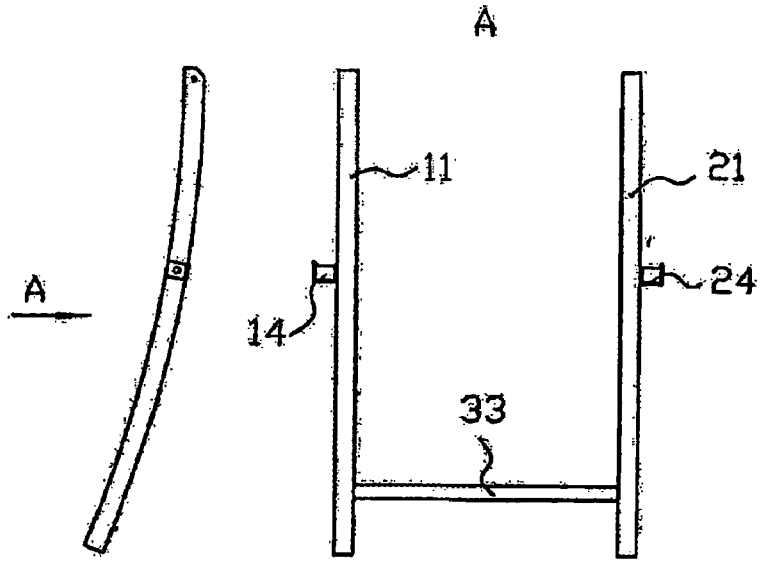
FIG. 5 is a perspective view of the first leg and the second leg of the embodiment 1.
Figure 6:
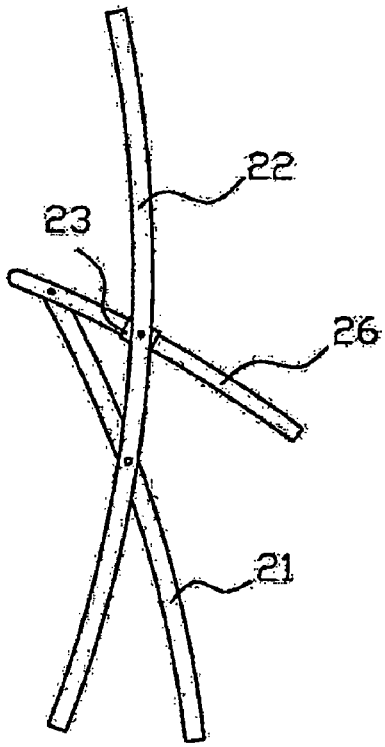
FIG. 6 is a perspective view of the folding process of the embodiment 1.
Figure 7:
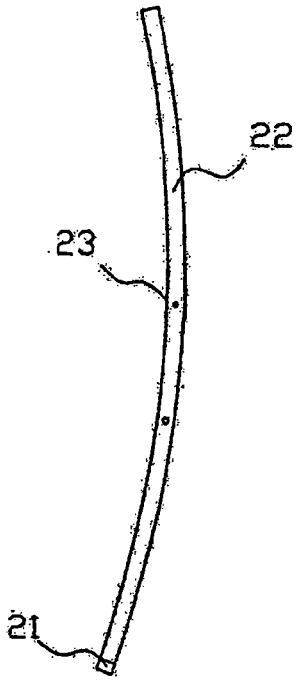
FIG. 7 is a perspective view after the chair is folded of the embodiment 1.
Figure 8:
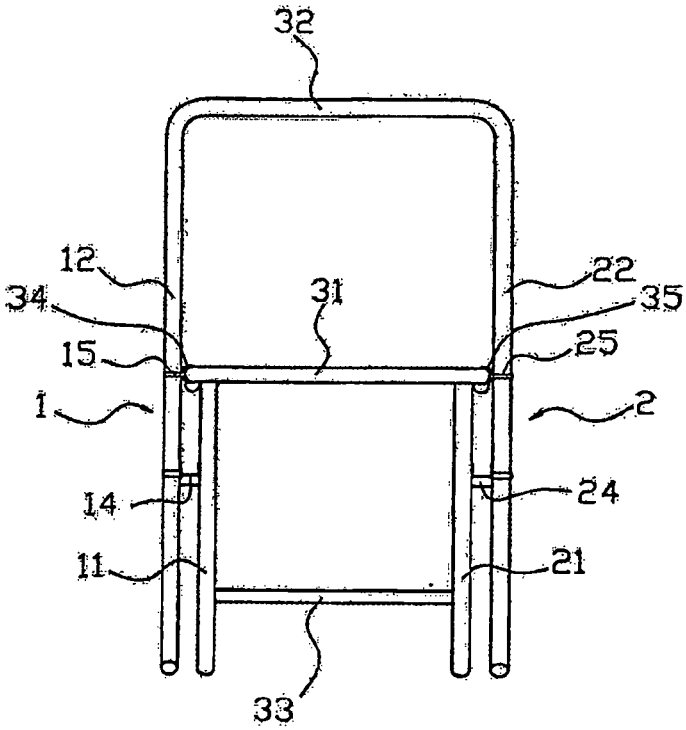
FIG. 8 is an elevational view of the embodiment 2.
Figure 9:
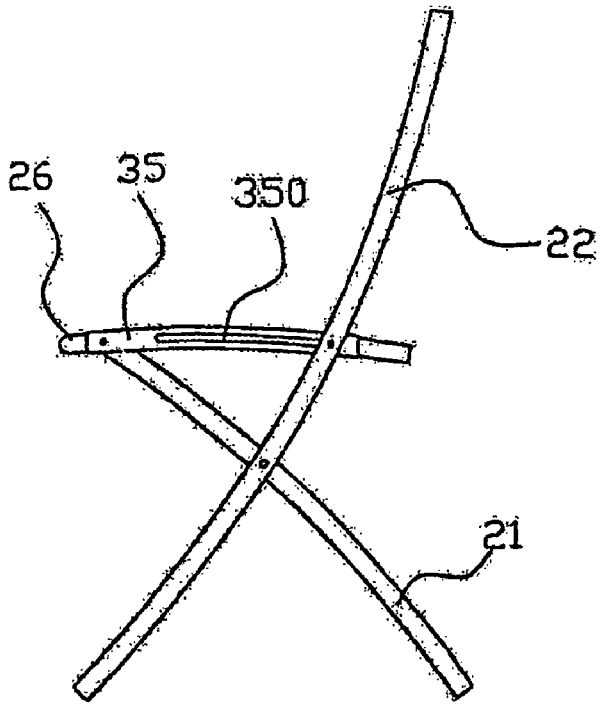
FIG. 9 is a right side view of the embodiment 2.
Figure 10:
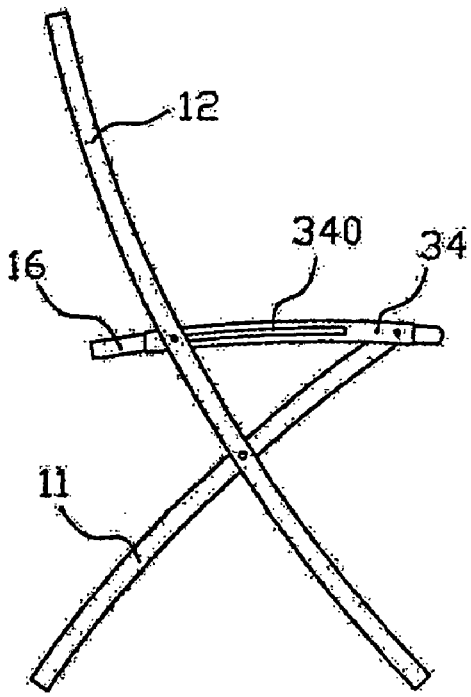
FIG. 10 is a left side view of the embodiment 2.
Figure 11:
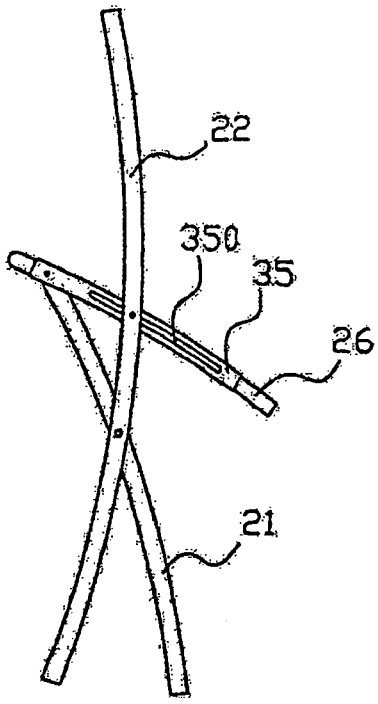
FIG. 11 is a perspective view of the folding process of the embodiment 2.
Figure 12:
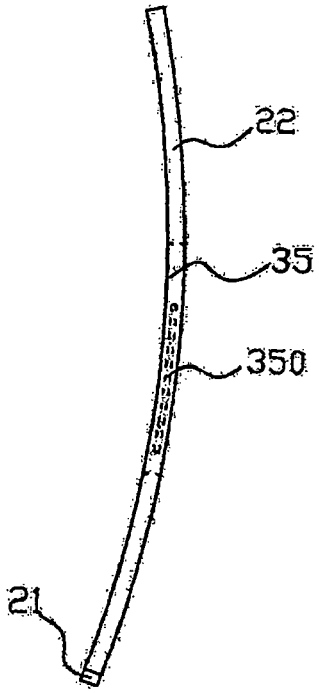
FIG. 12 is a perspective view after the chair is folded of embodiment 2.

Embodiment 1 is the folding support of a folding chair of the present invention, referring to FIGS. 1-7, comprising a first folding support 1 and a second folding support 2, the first folding support 1 includes a first front leg 11, a first back leg 12 and a first horizontal bearing-rod 16, the upper-end of the first front leg 11 is pivotally connected to the front-end of the first horizontal bearing-rod 16, the middle part of the first front leg 11 is pivotally cross-linked with the middle-lower part of the first back leg 12, a first sliding thimble 13 is pivotally fixed on the inner lateral approximately middle part of the first back leg 12, the first horizontal bearing-rod 16 can be slidably shuttled in the first sliding thimble 13, the second folding support 2 includes a second front leg 21, a second back leg 22 and a second horizontal bearing-rod 26, its connection is similar to that of the first folding support 1, a second sliding thimble 23 is pivotally fixed on the inner lateral approximately middle part of the second back leg 22, the first horizontal bearing-rod 16 can be slidably shuttled in the second sliding thimble 23.

The first front leg 11, the second front leg 21 are located between the first horizontal bearing-rod 16 and the second horizontal bearing-rod 26, a first U shape connection piece 14 is fixed on the cross-linked joint of the first front leg 11 and the first back leg 12, the first horizontal bearing-rod 16 is deposited in the first U shape connection piece 14, a second U shape connection piece 24 is fixed on the cross-linked joint of the second front leg 21 and the second back leg 22, the second horizontal bearing-rod 26 is deposited in the second U shape connection piece 24.

The front-end of the first horizontal bearing-rod 16 and the front-end of the second horizontal bearing-rod 26 are connected by the first rail 31, the upper-end of the first back leg 12 and the upper-end of the second back leg 22 are connected by the second rail 32, the first horizontal bearing-rod 16, the second horizontal bearing-rod 26 and the first rail 31 are formed an integrative U shape pole, the first back leg 12, the second back leg 22 and the second rail 32 are also formed an integrative U shape pole. The lower part of the first front leg 11 and the lower part of the second front leg 21 are connected by the third rail 33.

In the first folding support 1, the distance between the joint of the first front leg 11, the first back leg 12 and the joint of the first front leg 11, the first horizontal bearing-rod 16, is longer than the distance between the joint of the first front leg 11, the first back leg 12 and the joint of the first back leg 12, the first horizontal bearing-rod 16. In the second folding support 2, its corresponding structure is the same as the structure of the first folding support 1.

The first back leg 12 presents a backswept bending arc line, the shape of the first front leg 11 and the shape of the first horizontal bearing-rod 16 correspond with the shape of the first back leg 12, when the joint of the first horizontal bearing-rod 16 and the first back leg 12 is sliding to the front-end of the first horizontal bearing-rod 16, the first horizontal bearing-rod 16 is located between the first front leg 11 and the first back leg 12, and is clipped in the first U shape connection piece 14, so the first horizontal bearing-rod 16, the first front leg 11, the first back leg 12 are located on a same arc surface. The corresponding structure of the first back leg 12, the first front leg 11, the first horizontal bearing-rod 16 is the same as the before-mentioned structure. Therefore, the folding structure presents an arc surface after the chair is folded.

The folding structure includes a seat and a backrest that constitutes a folding chair, where the folding chair presents an arc surface after being folded. If the first front leg 11, the first horizontal bearing-rod 16, the first back leg 12 are straight poles, it will be a plane after it is folded.

Embodiment 2 of the present invention, referring to FIGS. 8-12, the main difference is that the connection structure between the first horizontal bearing-rod 16 and the first back leg 12 and the connection structure between the second back leg 22 and the second horizontal bearing-rod 26 are different from the structure of embodiment 1. A first canular pole 34 is fixed on the outer lateral of the first horizontal bearing-rod 16, a first sliding groove 340 is fixed along the length direction of the first canular pole 34, a first convex pole 15 is fixed on the inner lateral approximately middle part of the first back leg 12, the first convex pole 15 can be slidably shuttled in the first sliding groove 340, a second canular pole 35 is fixed on the outer lateral of the second horizontal bearing-rod 26, a second sliding groove 350 is fixed along the length direction of the second canular pole 35, a second convex pole 25 is fixed on the inner lateral approximately middle part of the second back leg 22, the second convex pole 25 can be slidably shuttled in the second sliding groove 350.

Figure 13:
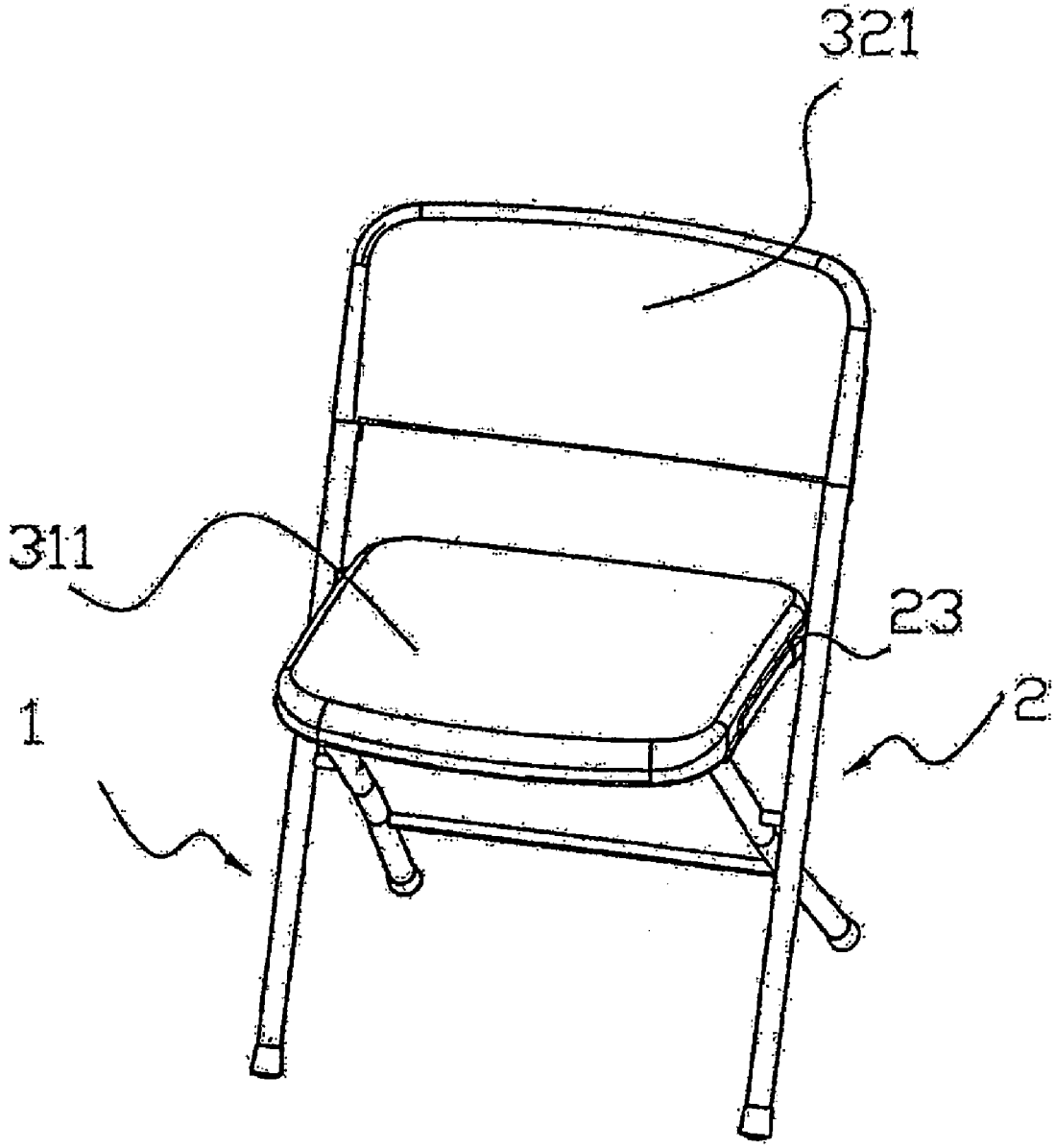
FIG. 13 is a stereogram of the embodiment 3.
Figure 14:
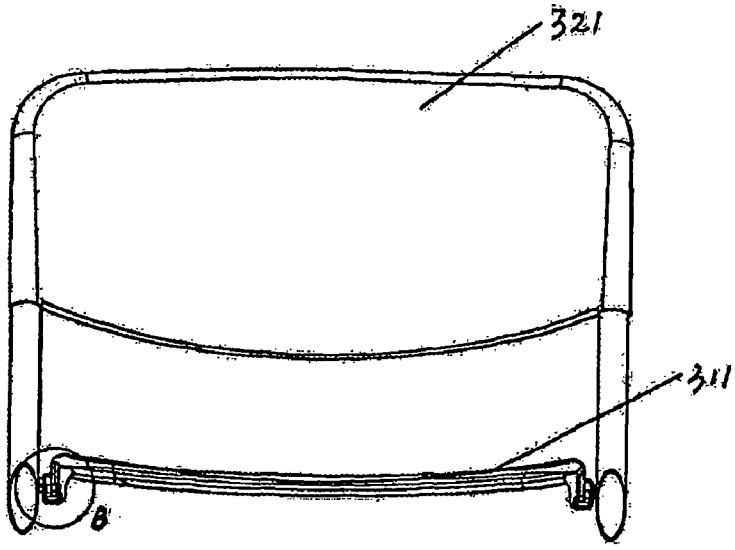
FIG. 14 is a perspective view of the sliding structure of the embodiment 3, B is the partial amplificatory view.
Figure 14:
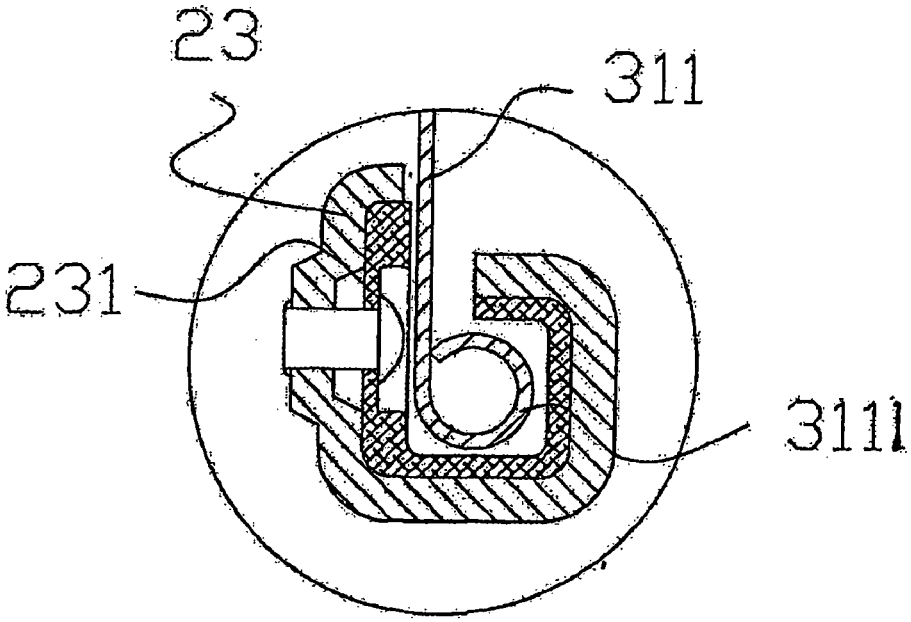

Embodiment 3 as shown in FIG. 13, 14, this is the folding chair which is made from the folding structure, consisting of a first folding support 1, a second folding support 2, the two lateral sides of a seat 311 are respectively slidably and pivotally connected to the back legs by the sliding thimbles 13, 23, the front-end of the seat 311 is pivotally connected to the front legs. The difference from the embodiments which are above-mentioned is, there is no frame outside of the seat of the folding chair, an inward roll line member 3111 is on the lateral side of the seat, it is directly connected to the two back legs by the sliding thimbles 13, 23, the sliding thimbles is pivotally connected to the back legs, the lateral portion of the seat is wrapped in the sliding thimble and is slidably connected to the sliding thimble, an inner part 231 is in the sliding thimble 23.

Embodiment 4 as shown in FIG. 15: Its character is that the lateral line 312 of the seat is the outwards convex sliding line 3112, it is directly connected to the two back legs by the sliding thimbles 13, 23, the sliding thimbles 13, 23 are pivotally connected to the back legs, the lateral portion of the seat is wrapped in the sliding thimble and is slidably connected to the sliding thimble, a concessive gap or aperture 311 of the folding back leg is on the back of the seat. The concessive aperture 3113 of the seat is for the folding of the front leg. This embodiment is that the convex line on the out of the seat lateral is set in the sliding thimble.

Figure 16:
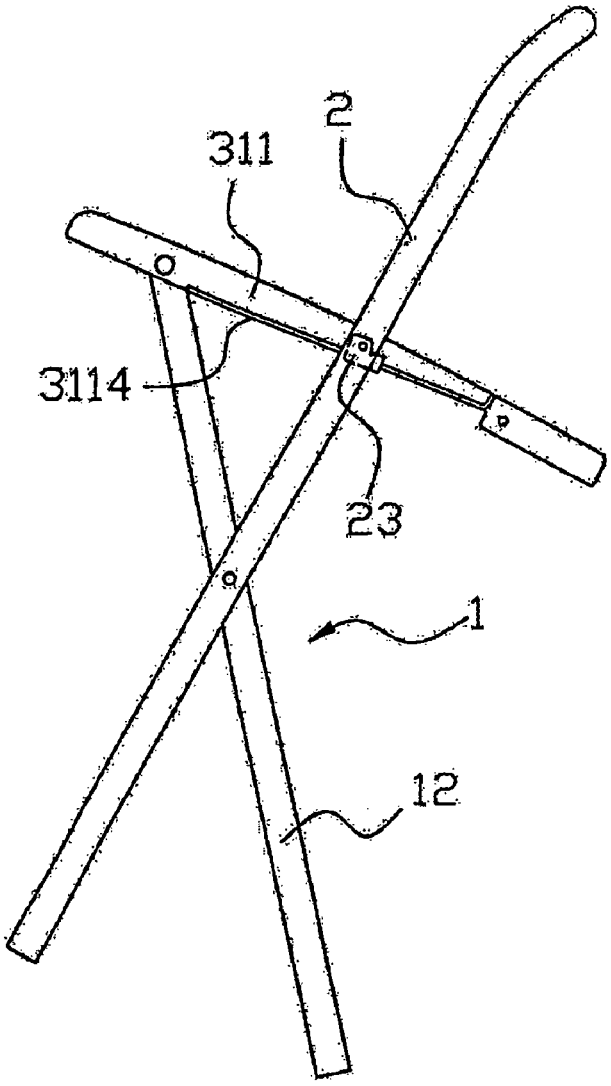
FIG. 16 is a perspective view of the embodiment 5.
Figure 17:
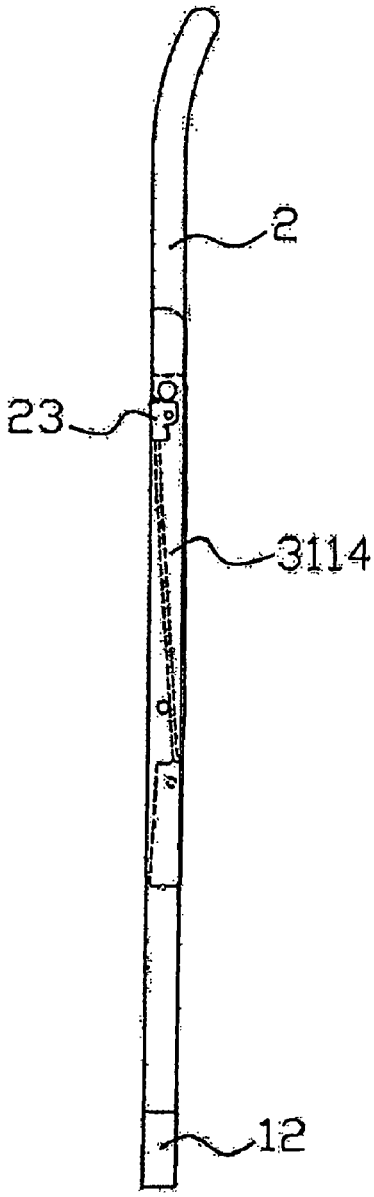
FIG. 17 is a perspective view of the folded estate of the embodiment 5.
Figure 18:
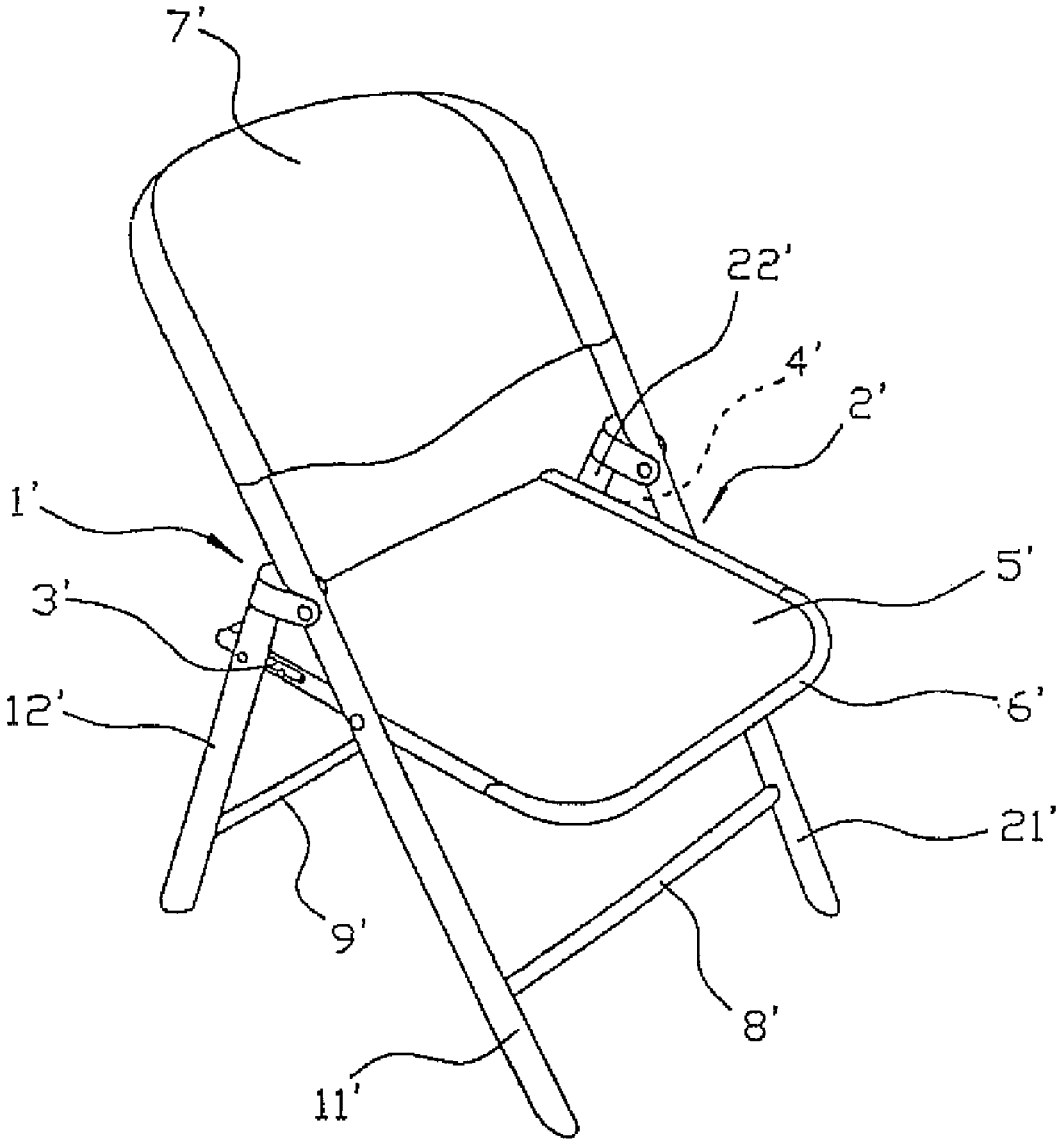
FIG. 18 (Prior Art)
FIG. 18 is a perspective view of the existing folded chair.

Embodiment 5 as shown in FIGS. 16, 17, there is no concessive aperture for the folding of the front leg set on the seat, but an incline 3114 is set on it, the front leg is deposited in the incline gap of the seat lateral after the chair is folded.

As mentioned above, these are five preferred embodiments of the present invention, but the embodiments do not limit the scope of the present invention, but rest with the horizontal bearing-rod or the seat is slidably and pivotally connected to the back leg, all the parts of the chair are located in a same plane after it is folded, the equivalent change and the modification based on the contents of the technical project and the specification of the present invention belong to the scope of the present invention.

The above-mentioned folding structure of the folding chair is that the front legs are absolutely deposited in the back legs, so it can occupy less space when it is stored or conveyed, at the same time, the structure is simple but can bear strong strength, so the strength of the chair is high, the cost of the production is low.

I claim:

1. A folding chair, comprising: a first folding support and a second folding support, the first folding support includes a first front leg, a first back leg and a seat, an upper end of the first front leg is pivotally connected to a lateral front end of the seat, the first front leg is pivotally cross-linked with the first back leg, a first lateral side of the seat is slidably and pivotally connected to a first sliding piece on the first back leg; the second folding support includes a second front leg, and a second back leg, an upper end of the second front leg is pivotally connected to a lateral front end of the seat, a second lateral side of the seat is slidably and pivotally connected to a second sliding piece on the second back leg, wherein a distance between a joint connecting the first front leg and the first back leg and a joint connecting the first front leg and the seat is longer than a distance between the joint connecting the first front leg and the first back leg and a joint connecting the first back leg and the seat, wherein said first sliding piece is a first sliding thimble that is pivotally fixed on an inner, lateral middle part of the first back leg, the first sliding thimble is pivotally connected to the back leg, the seat having a downwardly convex shape, one of the lateral sides of the seat is slidably shuttled in the first sliding thimble, said second sliding piece includes a second sliding thimble that is pivotally fixed on the inner, lateral middle part of the second back leg, the other of the lateral sides of the seat is slidably shuttled in the second sliding thimble.

2. A folding chair, comprising: a first folding support and a second folding support, the first folding support includes a first front leg, a first back leg and a seat, an upper end of the first front leg is pivotally connected to a lateral front end of the seat, the first front leg is pivotally cross-linked with the first back leg, a first lateral side of the seat is slidably and pivotally connected to a first sliding piece on the first back leg, the second folding support includes a second front leg, and a second back leg, an upper end of the second front leg is pivotally connected to a lateral front end of the seat, a second lateral side of the seat is slidably and pivotally connected to a second sliding piece on the second back leg, wherein said first sliding piece is a first sliding thimble that is pivotally fixed on an inner, lateral middle part of the first back leg, the first sliding thimble is pivotally connected to the back leg, the seat having a downwardly convex shape, one of the lateral sides of the seat is slidably shuttled in the first sliding thimble, said second sliding piece includes a second sliding thimble that is pivotally fixed on the inner, lateral middle part of the second back leg, the other of the lateral sides of the seat is slidably shuttled in the second sliding thimble, and wherein the first and second lateral sides of the seat are slidably and pivotally connected to the first and second back legs, wherein a first sliding groove is fixed on the first lateral side of the seat, the first sliding piece includes a first convex pole that is fixed on a corresponding position of an inner lateral side of the first back leg, the first convex pole is slidably shuttled in the first sliding groove; a second sliding groove is fixed on the second lateral side of the seat, the second sliding piece includes a second convex pole that is fixed on a corresponding position of an inner lateral side of the second back leg, the second convex pole is slidably shuttled in the second sliding groove.

3. A folding chair, comprising: a first folding support and a second folding support, the first folding support includes a first front leg, a first back leg and a seat, an upper end of the first front leg is pivotally connected to a lateral front end of the seat, the first front leg is pivotally cross-linked with the first back leg, a first lateral side of the seat is slidably and pivotally connected to a first sliding piece on the first back leg; the second folding support includes a second front leg, and a second back leg, an upper end of the second front leg is pivotally connected to a lateral front end of the seat, a second lateral side of the seat is slidably and pivotally connected to a second sliding piece on the second back leg, wherein two concessive gaps are on back-ends of the seat, the front leg is deposited in one of said two concessive gaps after the chair is folded, and wherein said first sliding piece is a first sliding thimble that is pivotally fixed on an inner, lateral middle part of the first back leg, the first sliding thimble is pivotally connected to the back leg, the seat having a downwardly convex shape, one of the lateral sides of the seat is slidably shuttled in the first sliding thimble, said second sliding piece includes a second sliding thimble that is pivotally fixed on the inner, lateral middle part of the second back leg, the other of the lateral sides of the seat is slidably shuttled in the second sliding thimble.

* * * * *